United States Patent [19]

Fritz et al.

[11] 3,945,299

[45] Mar. 23, 1976

[54] LINEAR POSITIONING APPARATUS

[75] Inventors: Rene E. Fritz, Albany; Ted C. Foster, Corvallis, both of Oreg.

[73] Assignee: Albany International Industries, Inc., Albany, Oreg.

[22] Filed: June 24, 1974

[21] Appl. No.: 482,446

[52] U.S. Cl. ..... 91/31; 91/24; 91/167 R; 91/367; 91/385; 91/410; 91/445; 83/488; 83/530

[51] Int. Cl.[2] ..... F15B 13/04

[58] Field of Search ..... 91/6, 20, 23, 24, 31, 167 R, 91/358 R, 358 A, 367, 368, 385, 386, 393, 399, 419, 445, 453, 410; 83/488, 530

[56] References Cited

UNITED STATES PATENTS

| | | | |
|---|---|---|---|
| 2,846,982 | 8/1958 | Huppert et al. | 91/385 X |
| 2,886,010 | 5/1959 | Hayes et al. | 91/385 |
| 3,011,740 | 12/1961 | Hayner | 91/167 X |
| 3,183,785 | 5/1961 | Bidlack | 91/20 |
| 3,307,584 | 3/1967 | Czernek | 91/167 X |
| 3,361,034 | 1/1968 | Rothrock | 91/42 |
| 3,534,679 | 2/1968 | Forichon | 91/358 R X |
| 3,635,020 | 1/1972 | Mahlmann | 91/6 X |
| 3,641,877 | 2/1972 | Hebert | 91/167 R X |
| 3,722,365 | 3/1973 | Olsson | 91/445 X |
| 3,763,744 | 10/1973 | Fournell et al. | 91/32 X |

*Primary Examiner*—Martin P. Schwadron
*Assistant Examiner*—Abraham Hershkovitz
*Attorney, Agent, or Firm*—Klarquist, Sparkman, Campbell, Leigh, Hall & Whinston

[57] ABSTRACT

A positioning apparatus includes a master hydraulic positioning cylinder having a relatively long stroke capability and a train of additively connected, short-stroke pneumatic control cylinders for controlling the length of stroke of the master cylinder and thus the positioning of a variable-position tool such as a band saw. One end of the cylinder train is connected by a feedback rod to an extensible portion of the master cylinder. A connecting rod connects the opposite end of the train directly to the spool of a three-position servo valve which controls the flow of hydraulic fluid to and from opposite sides of the master cylinder. When air pressure is admitted to a selected side of a selected control cylinder, at least a portion of the train shifts initially in a direction to move the servo valve to an operating position to begin stroking the master cylinder in a desired direction. Stroking movement of the master cylinder is transmitted through the feedback rod to the train to stroke the selected control cylinder until its piston bottoms out, after which continued stroking of the master cylinder shifts the train to close the servo valve and stop the master cylinder when it has stroked through a distance corresponding to the full stroke of the selected control cylinder. The cylinder train includes a pair of "lost motion" cylinders enabling movement of the train beyond the limits of movement of the servo valve. This lost motion of the train activates a high-speed valve in the hydraulic circuit to stroke the master cylinder at high speed and a "final set" cylinder in the train to ensure that final stroking of the master cylinder to a selected setting always occurs from the same direction to eliminate setting errors from lost motion in the system. A lockout valve in the hydraulic system overrides the servo and high-speed valves when the controlled tool is in an operating condition to block flow to the master cylinder and prevent possible damage to the tool or positioning apparatus.

25 Claims, 1 Drawing Figure

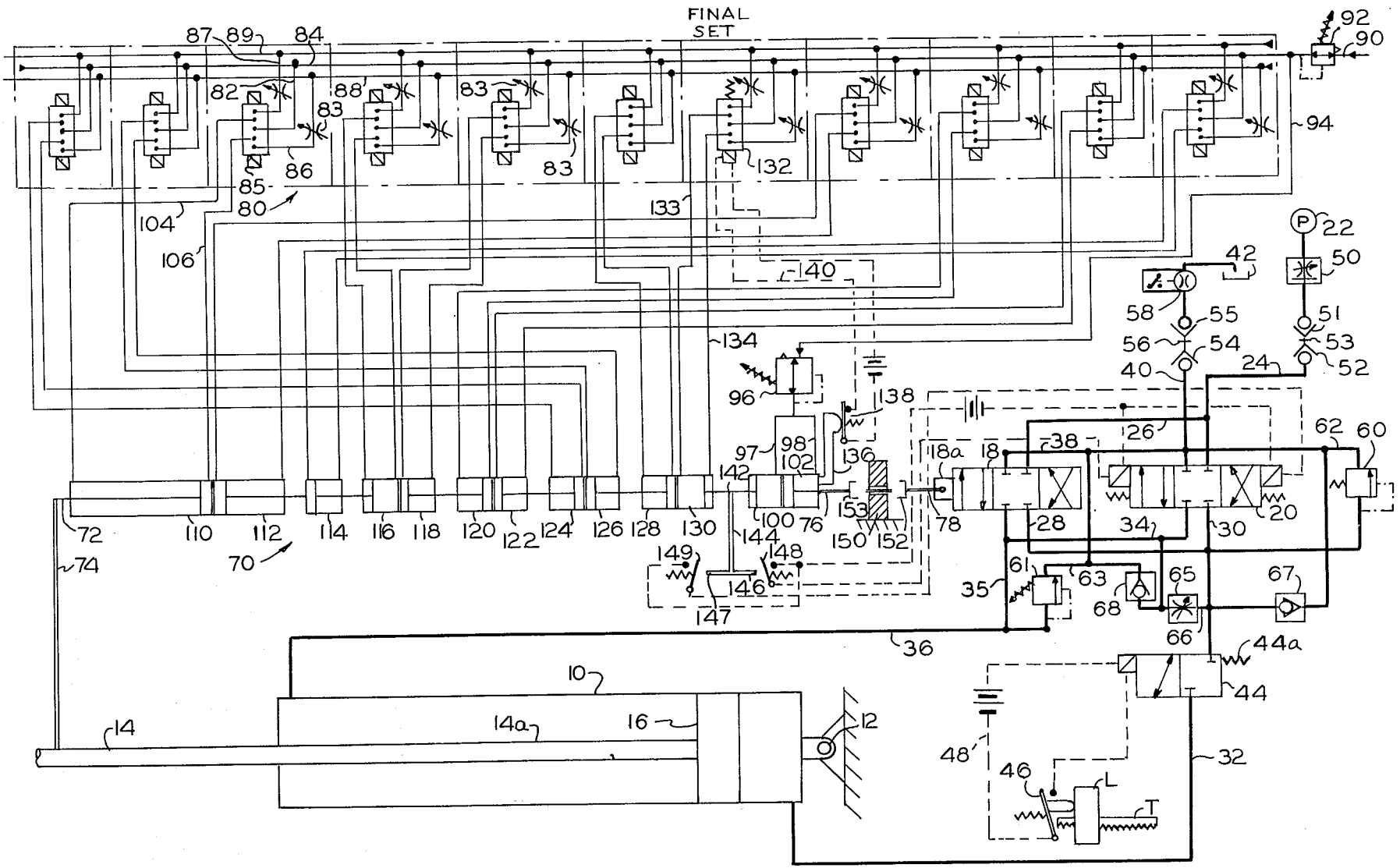
FINAL SET

LINEAR POSITIONING APPARATUS

BACKGROUND OF THE INVENTION

1. Field of the Invention

The present invention relates to a linear positioning device for moving a tool or other load to selected predetermined positions.

2. Description of the Prior Art

The use of a relatively long-stroke master hydraulic cylinder operated by relatively high pressure and a servo control system including a train of additive, short-stroke pneumatic cylinders operated by a relatively low pressure to control the stroking of the master cylinder and thus the variable positions of a tool or other controlled load is known. Such a prior positioning apparatus is shown, for example, in U.S. Pat. No. 3,361,034. Positioners of this type have inherent advantages in compactness, simplicity and accuracy as compared to other, more conventional types of positioning setworks.

Nevertheless, such prior positioners commonly include as part of the servo control, in addition to the pneumatic control cylinder train, a complex combination of pneumatic, electrical, mechanical and hydraulic components which are exceedingly difficult for plant maintenance personnel to understand and thus service. Such complexities have also effected adversely the accuracy and dependability of prior such positioners.

Another shortcoming of prior such positioners is the lack of any built-in safeguard to prevent operation of the positioner when the controlled tool is in an operating or other condition under which movement could damage the tool, workpiece or positioning apparatus.

Accordingly there us a need for an improved linear positioner of the general type utilizing a master hydraulic positioning cylinder and a train of pneumatic servo control cylinders which eliminates or at least minimizes the foregoing deficiencies of prior such positioners.

SUMMARY OF THE INVENTION

The present invention is an improved linear positioner of the type having a hydraulic positioning or master cylinder whose stroke is controlled by a train of additive short-stroke pneumatic cylinders.

The linear positioner of the present invention is an improvement over prior such positioners in simplicity, accuracy, dependability and ease of maintenance.

The linear positioner of the invention features a direct mechanical connection between the servo control cylinder train and a servo valve for controlling the flow of hydraulic fluid to and from the set master cylinder in direct response to movement of the cylinder train. This feature eliminates any other intervening complex mechanical, electrical or fluid servo mechanism common with prior such positioners, thus reducing the possibility of introducing undesired lost motion into the system, increasing the system's responsiveness, reducing its complexities and increasing its dependability and accuracy.

Another feature of the linear positioner of the invention is a servo valve which operates to provide an initial and final stroking of the master cylinder at slow speed, and a high-speed valve which operates to provide a high-speed stroking of the master cylinder through most of its stroking movement. The servo and high-speed valves are operated sequentially, the latter through movement of the cylinder train beyond that necessary to shift the servo valve to operating position, as permitted by a pair of "lost motion" cylinders in the train.

Still another feature of the positioner of the invention is a "final set" cylinder in the cylinder train operable to ensure that the final stroking of the master cylinder to its selected position always occurs from the same direction to eliminate the effects of any lost motion in the system. The final set cylinder is activated by a predetermined movement of the train in one direction as permitted by the lost motion cylinders.

Another feature of the invention is a lockout valve in the hydraulic system which operates to override the servo and high-speed valves and to block flow to or from the master cylinder when the tool or other load whose position is controlled by the master cylinder is in a condition such that the tool or load should not be moved.

The foregoing and other features, objects and advantages of the invention will become more apparent from the following detailed description which proceeds with reference to the accompanying drawing.

BRIEF DESCRIPTION OF DRAWING

In the drawing the single FIGURE is a schematic diagram of a linear positioning apparatus in accordance with the invention.

DETAILED DESCRIPTION

Hydraulic System

The illustrated apparatus includes a master hydraulic positioning or set cylinder 10 anchored at one end at 12 and having a positioning rod 14 extending from the opposite end. Such positioning rod forms a continuation of an extensible piston rod 14*a* of a piston 16 of the cylinder. Positioning rod .14 may be connected directly to a band saw, edger, line bar, chipper head or other tool in a sawmill or to tools or loads in other applications where incremental positioning of the tool or load is desired. Such tools or loads, the positioning rod 14 and any intervening connections comprise a means positionable by the master cylinder.

The flow of a hydraulic fluid to and from the opposite ends of the double-acting master cylinder 10 is controlled by a servo valve 18 and a high-speed valve 20. Hydraulic pressure fluid is supplied to these valves from a pump 22 through a primary supply line 24 and a branch supply line 26 which connect the two valves in parallel with one another. Downstream of the servo and high-speed valves flow is through lines 28, 30, and 32 to the fixed end of the master cylinder and through lines 34, 35, 36 to the rod end of such cylinder. A return line 38 leads from servo valve 20 to a connection with the primary return line 40 leading from high-speed valve 20 back to reservoir 42.

A lock-out valve 44 intersected in lines 30, 32 between the servo and high-speed valves and the fixed end of master cylinder 10 overrides the operation of such two valves and blocks flow to or from the master cylinder under certain conditions. As shown, lockout valve 44 is a two-position spool valve spring biased to a flow-blocking position. The valve is solenoid actuated to its open position when a limit switch 46 of an electrical circuit 48 is closed. Limit switch 46 is normally closed but is opened to permit flow, for example, when a tool, such as a band saw T, positionally controlled by the master cylinder, operates on a workpiece, such as the log L. Under such operating conditions any attempted stroking of the master cylinder would likely either damage the saw or the positioning apparatus.

Primary hydraulic supply line 24 includes a variable flow control valve 50 and check valves 51, 52 on opposite sides of the quick disconnect coupling 53. The primary return line 40 of the hydraulic system includes check valves 54, 55 on opposite sides of the quick disconnect coupling 56. Such line also includes a flow switch 58 which is normally open when the system is operational but which closes in response to any movement of the master cylinder after final positioning to prevent flow through the return line. Couplings 53, 56 separate the hydraulics of the potitioning unit from the plant hydraulic supply.

High-pressure relief valves 60, 61 in lines 62, 63, respectively, bypassing the servo and high-speed valves, relieve system pressure such pressure exceeds a predetermined maximum. Such relief valves return flow through their lines 62, 63 and primary return line 40 to reservoir 42.

A flow-metering valve 65 in a line 66 interconnecting fluid lines 30, 36 leading from the servo and high-speed valves to opposite sides of the master cylinder serves to equalize pressure on opposite sides of piston 16 during extension and retraction of cylinder 10 os that stroking in both directions is at about the same speed. Although line 66 is connected to bypass return lines 62, 63, flow bypassing the servo and high-speed valves is prevented by check valves 67, 68.

Both servo valves 18 and high-speed valve 20 are threeposition spool valves normally centered to flow-blocking positions as shown to lock master cylinder 10 against extension and retraction. The two operating positions of the two valves are identical, with the illustrated left-hand positions directing flow to the fixed end of the master cylinder and the right-hand positions directing flow to the rod end of such cylinder. The high-speed valve functions to increase the rate of flow of hydraulic fluid to and from the master cylinder when such valve is shifted to one of its two operating positions, thereby increasing the stroking speed of the cylinder. The high-speed valve is programmed always to shift in the same direction as the servo so that both valves are always in the same operating mode. The high-speed valve is also programmed to shift to an operating position after the servo valve shifts and to return to its neutral position before the servo valve returns to its neutral position, so that the beginning and end of any stroke of the cylinder is always at slow speed.

The servo valve is mechanically operated by a servo control system. Such system controls the variable length of a stroke of the master cylinder. The high-speed valve is solenoid-actuated to its operating positions, by the same servo control system in a manner to be described.

Pneumatic-Mechanical Servo Control System

The servo control system is basically a pneumatic-mechanical system, the heart of which is a train of mechanically interconnected small-stroke pneumatic control cylinders indicated generally at 70. These cylinders are additively connected so that the total stroke capability of the train approximates and is only slightly less than the full stroke of master cylinder 10. One end 72 of the servo cylinder train is rigidly connected by a feedback rod 74 to positioning rod 14 of the master cylinder. The opposite end 76 of the servo cylinder train is directly connected to the operating stem 18a of servo valve 18 by a connecting rod 78. The individual servo control cylinders of the train 70 are interconnected such that an expansion or contraction of one such cylinder through its full stroke effects a corresponding expansion or contraction of the total length of the train.

Extension and retraction of the individual servo control cylinders is effected through a bank of corresponding air valves indicated generally at 80. Each air valve in the bank is solenoid actuated, although such valves could be actuated manually or by other means. Each valve in bank 80 is connected by an air supply line 82 to an air supply manifold 84 and by dual air exhaust lines 86, 87 to a pair of exhaust manifolds 88, 89 respectively. Air manifold 84 is connected to a primary air supply line 90 leading from a source of air pressure (not shown).

Just upstream of the manifold an air pressure regulator 92 in air supply line 90 reduces the air pressure to the manifold to a predetermined operating level, such as, for example, 100 p.s.i. Just downstream from the first pressure regulator 92 a branch air supply line 94 leads to a second air pressure regulator 96, which reduces the air pressure in line 94 to a level of, for example, 20 to 30 p.s.i., and in any case substantially below the level of operating pressure in air manifold 84. This low pressure is then directed through branch air supply lines 97, 98 to a pair of back-to-back connected short-stroke single-acting air cylinders 100, 102 in the train 70. Low-pressure line 98 leads to the rod end of control-cylinder 102, and low-pressure line 97 leads to the cap end of air cylinder 100. Thus cylinder 102 is normally maintained in a retracted condition, and cylinder 100 is normally maintained in an extended condition as shown. These pairs of low-pressure air cylinders serve as a means of introducing a controlled degree of lost motion in the cylinder train to initiate operation of high-speed valve 20 in a manner that will soon be apparent.

Each air valve in bank 80 includes a pair of flexible supply-return air lines 104, 106 leading from ports in the valve to the rod and cap ends of its corresponding air cylinder. In the diagram, when the solenoid at the lower end of one such air valve 85 is energized, the valve shifts upwardly so that air from supply line 82 flows through the valve to line 104 and thus to the rod end of the corresponding air cylinder 110. At the same time the valve connects line 106 to exhaust line 86 and through a variable flow control orifice 83 to exhaust manifold 88 so that the cylinder is retracted as shown. When the upper solenoid of the same air valve 85 is energized, the valve shifts downwardly so that it connects air supply line 82 with line 106 leading to the cap end of the corresponding cylinder. Line 104 connects with exhaust line 87, and the cylinder tends to extend.

When the servo system is energized, there is a constant supply of air at operating pressure in manifold 84, and each air valve in bank 80 is maintained by one or the other of their solenoids or other means in one of its two operating positions so that air is maintained on one or the other side of each servo cylinder in train 70. Thus each servo cylinder, except when shifting, is maintained in either its fully extended or its fully retracted condition, depending on the stroke setting of master cylinder 10. From the foregoing description it will be apparent that each air valve in bank 80 is a two-position, five-ported valve with three ports on the manifold side and two ports on the cylinder side of the valve. The function of variable flow controls 83 in the exhaust lines 86, 87 of the air valves controlling all but certain minor servo cylinders 122–128 is to control the speed of shifting of the cylinders so that their piston rods are not damaged or broken during shifting movement.

Each control cylinder of train 70 has a predetermined stroke for stroking the set cylinder 10 through a corresponding distance. For example, the illustrated servo cylinder train, air cylinder 110 has an 8-inch stroke, its adjacent cylinder 112 has a 4-inch stroke. Continuing in succession, the other cylinders in the train include cylinder 114 with a 2-inch stroke, cylinder 116 with a 1-inch stroke, cylinder 118 with a ½-inch stroke, cylinder 120 with a ¼-inch stroke, cylinder 122 with a ⅛-inch stroke, cylinder 124 with a 1/16-inch stroke, cylinder 126 with a 1/32-inch stroke, and cylinder 128 with a 1/64-inch stroke. The next cylinder down the line in the train is a special-purpose "final set" cylinder 130 with a ¼-inch stroke. The two previously mentioned special-purpose lost motion cylinders 100, 102 each have a ½-inch stroke. From the foregoing it will be apparent that the total additive stroke of air cylinders 110–128 is approximately 16 inches. This means that the cylinder train is capable of moving master cylinder 10 through a total stroke of approximately 16 inches. This determination does not take into consideration the strokes of special-purpose cylinders 130, 100, 102 since these cylinders are not used to determine the length of stroke of the master cylinder. However, because of the action of final set cylinder 130 and the lost motion cylinders, the master cylinder should have a total stroke capability slightly greater than the total stroke of the servo train, in this case about one inch greater.

Final set cylinder 130 of the train is controlled by a special final set air valve 132 in bank 80. Air valve 132 is spring biased to a position wherein air supply line 82 for such valve supplies air to a line 134 leading to the rod end of cylinder 130 to maintain the cylinder in a retracted condition. However, in a static condition of cylinder train 70, a switch actuator 136 carried by the pair of lost motion cylinders 100, 102 maintains a limit switch 138 closed to complete an electrical circuit 140 including the solenoid of valve 132. The solenoid when energized maintains valve 132 in an upper position to direct air pressure to the fixed end of final set cylinder 130 through a line 133.

The coupled piston rods 142 interconnecting the pistons of final set cylinder 130 and high-speed cylinder 100 carry a mechanical switch actuator 144 including actuating cam arms 146, 147. These arms close normally open limit switches 148, 149, respectively, in electrical circuits including the solenoids for actuating high-speed valve 20 in the hydraulic system.

The fractional stroke cylinders 126, 128 serve as zero positioners for a saw or tool subject to wear. For example, after a saw is sharpened, it is not unusual for the teeth of the saw, which are reset after sharpening, to have a changed reference position with respect to the log or other workpiece. The reset saw may be offset up to 1/32 of an inch from the centerline of the cut desired. Thus when a saw is replaced on a band mill or other sawing machine, the zero position of positioning rod 14, and thus the saw blade, can be adjusted by appropriate use of the zero positioning cylinders 126, 128. The zero positioning cylinders are not used in the ordinary course of shifting rod 14 after they have once been used to adjust the zero position of the saw. The zero positioning cylinders could be omitted, for example, where adjustment for tool wear, or for resetting of saw teeth or the like is not required.

A stop means is provided at a position along the length of connecting rod 78 between the end 76 of the cylinder train and the servo valve 18 to limit shifting movement of such connecting rod to the length of travel required to shift the servo valve from its centered position to its operating positions, Such stop means includes a stop block 150 at a fixed position along the connecting rod and a pair of abutment members or bumpers 152, 153 on the rod and spaced equally on opposite sides of stop 150 when servo valve 18 is centered. Each bumper might be spaced, for example, 0.012 inches from the stop block with the servo valve centered, such spacing being the required travel to shift the servo valve in either direction from its centered position to one of its two operation positions. However, as previously mentioned, the two low-pressure air cylinders 100, 102 serve as a lost motion means to permit movement of the cylinder train beyond the limits of travel of rod 78 permitted by bumpers 152, 153, in order to fulfill additional functions of the system.

Although thirteen servo air valves are used in the train 70, with such cylinders having specific strokes for purposes of illustration, it should be appreciated that the servo cylinder train could have any number of air cylinders of any desired stroke to meet the stroke setting requirements and total stroke requirement of a specific master cylinder used to meet the specific requirements of a given controlled tool or load. Thus if a very large number of servo cylinders is required in a servo train, such cylinders may be arranged in stacked tiers for compactness, with the last cylinder in the lower tier being connected by a suitable rigid connecting rod to the first cylinder in the next higher tier and so on until all of the required number of servo cylinders are accomodated. In any case, the last cylinder of the uppermost tier would be directly connected by the equivalent of the connecting rod 78 to the servo valve. For clarity of illustration, all of the servo cylinders are shown in a single line, which in practice will usually not be objectionable so long as the line does not exceed to any appreciable extent the overall length of the set cylinder.

From the foregoing description it will also be apparent that the servo cylinders must be capable of free movement between the opposite ends of the train. Only the first and last cylinders of the train are attached to something, the first to the positioning rod of the master cylinder and the last to the servo valve. It is thus important in practice that the servo cylinders be mounted for free sliding movement without binding along a support surface or track (not shown) having a low coefficient of friction, such as a low-friction plastic.

OPERATION

Basic Operation

For purposes of illustrating the operation of the positioning apparatus, it is assumed that master cylinder 10 is operated under a hydraulic pressure of approximately 1,000 p.s.i. and that all of the air cylinders controlled by air valves in bank 80 are operated under an air pressure of about 100 p.s.i. Further, it is assumed that the two single-acting, low-pressure air cylinders 100, 102 are subjected to an operating air pressure of about 20 p.s.i., as determined by pressure regulator 96. It is also assumed that the air cylinders and master cylinder are in the positions shown, which is with the master cylinder one inch to the left of its fully retracted position because of the 1-inch air cylinder 116 being the only primary servo cylinder extended.

Now assuming that it is desired to shift positioning rod 14 8 inches to the left in the diagram, air is admitted to the right side of 8-inch servo cylinder 110 and exhausted from the opposite side by shifting air valve 85 in bank downwardly from its initial upper position. However, air pressure in the right side of cylinder 110 cannot extend the piston of such cylinder because the piston rod 72 is rigidly connected to the positioning rod 14 of the master cylinder, and the master cylinder's piston 16 is locked in a fixed position by balanced hydraulic pressure on opposite sides thereof because the servo and high-speed valves are in their flow-blocking centered positions. Thus air pressure behind the piston in air cylinder 110 causes the cylinder body to shift to the right in the diagram. This shifting movement shifts the entire cylinder train to the right because the other cylinders of such train are rigidly interconnected by their piston rods, which are held in fixed positions by air pressure on one side or the other of the pistons of such cylinders. The shifting of the cylinder train to the right in turn causes connecting rod 78 to shift servo valve 18 to the right, to an operating position admitting flow of 1,000 p.s.i. pressure fluid from supply lines 24 and 26 through the valve and into line 28 to the lockout valve 44. Assuming that the lockout valve is open, flow continues through such valve and through line 32 to the cap end the master cylinder 10. At the sam time, exhaust flow from the rod end proceeds through lines 36 and 35, valve 18, lines 38 and 40 to reservoir 42. Thus piston 16 of the master cylinder begins stroking toward the left in the diagram. As it does so, it permits the piston of servo cylinder 110 to advance to the left also until such piston bottoms out against the rod end wall of such cylinder. Thereafter continued stroking of the master cylinder to the left shifts the entire servo cylinder train to the left, returning servo valve 18 to its centered, flow-blocking position to stop the stroking of the master cylinder. At this point master cylinder piston 16 and positioning rod 14 will have moved through a total distance of eight inches from its initial position, the full stroke of servo cylinder 110.

To stroke master cylinder 10 in the opposite direction, air is admitted to the opposite side of the selected servo cylinder, causing an initial shifting movement of the cylinder train to the left in the diagram and thus shifting the servo valve to the left. This admits hydraulic pressure fluid to the rod end of the master cylinder to stroke such cylinder and the selected servo cylinder to the right until the servo cylinder bottoms out. Thereafter, continued stroking of the master shifts the cylinder train to the right to return servo valve 18 to its centered flow-blocking position, stopping stroking movement of the master cylinder after is has retracted through a total distance corresponding to the full stroke of the selected servo cylinder.

If positioning rod 14 of the set cylinder is to be shifted 12 inches to the left, air is admitted to the right or fixed end of servo cylinder 110 and also to the left or cap end of servo cylinder 112. This causes an initial shifting movement of the cylinder train, connecting rod 78 and servo valve 18 to the right, admitting hydraulic fluid under 1,000 p.s.i. to the right or cap end of set cylinder 10 to extend positioning rod 14 to the left. Extension of rod 14 continues until the pistons of servo cylinders 110, 112 bottom out at the rod ends of their respective cylinders. Thereafter continued extension of positioning rod 14 pulls the cylinder train to the left and thus the servo valve back to its centered position. At this point piston 16 and positioning rod 14 will have moved through a total distance of twelve inches to the left, the sum of the strokes of air cylinders 110, and 112. The remaining servo cylinders 114–128 operate in a similar manner to control the extension and retraction of the master cylinder through distances corresponding to the strokes of such cylinders.

High-Speed Function

Operation of the servo system to provide high-speed stroking of the master cylinder for position changes greater than a predetermined minimum will now be described. The low-pressure servo cylinders 100, 102 come into play to trigger high-speed operation of the master cylinder. Assume first that master cylinder 10 is to be shifted two inches to the left from its position shown. Air is thus admitted to the cap or left end of 2-inch servo cylinder 114. This moves the piston of such cylinder and thus the portion of the train connected to it to the right in the diagram about 0.012 inches, until bumper 153 abuts stop block 150. At this point servo valve 18 has shifted to an operating position admitting hydraulic fluid to the fixed end of the master cylinder.

However, when bumper 153 strikes stop 150, the piston of servo cylinder 114 continues its travel toward the right because it is being moved under 100 pounds pressure whereas the piston in low-pressure cylinder 100 is being resisted by a much lower 20 p.s.i. air pressure. Thus the piston in cylinder 100 shifts to the right, producing the previously mentioned lost motion which premits the train between cylinder 114 and cylinder 100 to continue shifting toward the right. When such train portion travels a predetermined distance to the right of, for example, ⅜ inch, arm 146 of switch actuator 144 carried by piston rod 142 closes limit switch 148 to energize the left-hand solenoid of high-speed valve 20. The solenoid shifts such valve toward the right, thereby increasing the rate of flow of hydraulic fluid to the right end of the master cylinder to increase the stroking speed of its pistons 16.

As the master cylinder begins stroking to the left, it permits air cylinder 114 to shift to the left also, with cylinders 110, 112. This continues until the piston of cylinder 114 bottoms against the right end of such cylinder. Thereafter continued stroking of master cylinder 10 to the left returns the piston of cylinder 100 to its extended position at the left end of such cylinder, reopening switch 148 to return high-speed valve 20 to its spring-centered neutral position and thus slow the stroking of the master cylinder. Thereafter, continued slow-speed stroking of the master cylinder to the left shifts the cylinder train and connecting rod 78 to the left to return servo valve 18 to its centered position, thereby stopping the cylinder. At this point the master cylinder will have stroked two inches to the left, the full stroke of servo cylinder 114, with the start and finish of the stroke being at slow speed, but with the major intermediate portion of the stroke being at high speed.

When the master cylinder is stroked in the opposite direction through a predetermined distance, high-speed stroking occurs through lost motion induced in the low-pressure servo cylinder 102 after bumper 152 abuts stop 150. The continued movement of the train to the left in the diagram pulls cylinder 102 to the left relative to its piston against the low pressure in such cylinder until switch-actuating arm 147 of actuator 144 closes limit switch 149 to energize the right-hand solenoid of the high-speed valve 20. This shifts the valve to the left, increasing the rate of flow to the rod end of the master cylinder to increase the retracting speed of piston 16.

Final Set Function

The final set cylinder 130 ensures that the final stroking movement of the piston on master cylinder 10 during any change in position of such piston always occurs from the same direction to eliminate cumulative errors in positioning caused by any lost motion in the system. In the illustrated system the final set cylinder 130 operates to ensure that the direction of final stroking of the master cylinder 10 is always toward the left in the diagram during both retraction and expansion of the cylinder to a new position. When cylinder train 70 is in the normal static condition shown, the pair of low-pressure cylinders 100, 102 are positioned so that switch actuator 136 maintains limit switch 138 in electrical circuit 140 closed to maintain air pressure on the left side of the piston of final set cylinder 130. Assuming now that it is desired to stroke master cylinder 10 1 inch to the right in the diagram, air is admitted to the left side of one-inch air cylinder 116. This causes an initial shifting of cylinder 116 and its connected train of cylinders toward the left, shifting servo valve 18 to an operating position to direct fluid into the left or rod end of the master cylinder. Continued movement of cylinder 116 to the left after bumper 152 strikes stop 150, as permitted by low pressure cylinder 102, opens limit switch 138 in circuit 140, shifting final set air valve 132 downwardly under the influence of its spring. This causes air under 100 p.s.i. pressure to enter line 134 and the rod or right end of final set cylinder 130 while the opposite side of such cylinder is exhausted to shift its piston to the left end of such cylinder, also as permitted by cylinder 102.

At this time fluid flow to the rod end of master cylinder 10 strokes piston 16 toward the right, whereby positioning rod 14 also permits the piston of servo cylinder 116 to shift right also until such piston bottoms against the right end of such cylinder. Thereafter the portion of cylinder train 70 including cylinders 116–130 and 100, 102 continues to move to the right as permitted by the movement or cylinder 102 relative to its piston until such piston bottoms against the left end of cylinder 102, thereby overstroking master cylinder 10 to the right ¼ inch, the full stroke of still-retracted air cylinder 130. At this time cylinder 102 recloses limit switch 138, returning air valve 132 to its upper position to reverse air flow to air cylinder 130. As air cylinder 130 extends, it shifts servo valve 18 to the right, through its neutral position to its left-hand position, reversing flow to the master cylinder so that such cylinder strokes to the left. Master cylinder 10 continues stroking to the left until the piston of air cylinders 130 bottoms against the right end thereof. Thereafter, continued stroking of the master cylinder returns servo valve 18 to its neutral position to stop the stroking of the master cylinder. Thus, under the example given, the master cylinder first stroked 1¼ inches to the right followed by a final positioning stroke of ¼ inch to the left for a net stroke to the right of 1 inch, corresponding to the full stroke of one-inch servo cylinder 116.

When the master cylinder is stroked to the left, the foregoing-described overstroking does not occur because the initial movement of the servo cylinder train is to the right, in which case limit 138 remains closed and final set cylinder 130 remains in the position shown. Thus regardless of the direction of stroking of the master cylinder 10, the final phase of its stroking is always to the left in the diagram.

Lockout Function

Lockout valve 44 is inserted in the hydraulic fluid supply line 32 leading to the fixed end of the master cylinder 10 downstream and in series with the servo and high-speed valves 18, 20. Thus such lockout valve overrides the action of the servo and high-speed valves to block flow to or from the master cylinder when the lockout valve is in its flow-blocking position as shown. Assuming that master cylinder 10 is connected to a band saw T to position such saw relative to a log L to be cut into lumber, it would be damaging to the saw and possibly the positioning apparatus if the master cylinder were operated while the saw T is in the log L. To prevent this, normally closed limit switch 46 in circuit 48 opens when the log or other workpiece L is in the area of the saw T, thereby causing lockout valve 44 to shift under the influence of a spring 44*a* to the flow-blocking position shown, preventing shifting movement of master cylinder 10. The presence of a log L at the saw may be sensed photoelectrically or by any other suitable means.

Although the present invention has been described with a hydraulic master cylinder and pneumatic servo cylinders, it will be appreciated that the invention applies broadly to any fluid-operated master and servo cylinders, whether operated by air, hydraulic fluid or any other liquid or gas.

Having illustrated and described what is presently one preferred embodiment of the invention, it should be apparent to those persons skilled in the art that the same permits of modification in arrangement, detail and application. We claim as our invention all such modifications as come within the true spirit and scope of the following claims.

We claim:

1. In a positioning apparatus having a large-stroke fluid-operated, double-acting master cylinder means for controlling the position of a variable position controlled device, a train of smaller-stroke fluid-operated control cylinder means additively interconnected and mounted for axial linear movement, means for selectively extending and retracting selected individual control cylinder means to determine the total length of said train, and servo valve means for controlling the flow of pressure fluid to and from said master cylinder means, characterized by:

said train of control cylinder means including a series of double-acting control cylinder means each normally biased by internal fluid pressure in either one of its two bottomed positions and each being selectively movable independently of the others under internal fluid pressure to the other of its two bottomed positions, one end of said cylinder train being rigidly connected by feedback means to a means positionable by said master cylinder means and the other end of said cylinder train being mechanically connected to said servo valve means for controlling the operating positions thereof such that admission of pressure fluid to one side of a selected said control cylinder means in sequence (1) first causes said selected control cylinder means to begin stroking toward the opposite side thereof by moving at least a portion of said train in one direction to shift said servo valve means to an operating position to begin stroking said master cylinder means, (2) then causes said selected control cylinder means to continue stroking toward said opposite side to a bottomed position as induced by continued stroking of said master cylinder means acting through said feedback means and (3) finally causes said train to shift said servo valve in an opposite direction to a neutral position through continued stroking of said master cylinder means acting through said feedback means to block flow to and from said master cylinder means whereby said master cylinder means is stroked through a distance corresponding to the full stroke of said selected control cylinder means.

2. Apparatus according to claim 1 wherein said servo valve means comprises a three-position spool valve including a centered said neutral position and two said operating positions including a first operating position on one side of said neutral position for directing flow to one side of said master cylinder means to extend said master cylinder means and a second operating position for directing flow to the opposite side of said master cylinder means to retract said master cylinder means.

3. Apparatus according to claim 2 including connecting rod means directly interconnecting one control cylinder means at said other end of said train and said spool valve such that movement of at least a portion of said train including said one control cylinder means in opposite directions causes a corresponding shifting of said spool valve between its neutral and operating positions.

4. Apparatus according to claim 3 including stop means positioned along said connecting rod means for limiting travel of said spool valve in opposite directions from said neutral position to said operating positions, and said cylinder train including lost motion means for enabling movement of said train in opposite directions beyond the limits of travel of said spool valve.

5. Apparatus according to claim 4 wherein said lost motion means comprises a pair of air-operated cylinder means in said cylinder train operable under an air pressure less than the operating fluid pressure of the remaining control cylinder means in said train.

6. Apparatus according to claim 1 wherein said control cylinder means of said cylinder train are air-operated, a pair of adjacent said control cylinder means being single-acting with one of said pair being air-biased to an extended condition and the other of said pair being air-biased to a retracted condition by air pressure less than the operating air pressure of the remaining said control cylinder means.

7. Apparatus according to claim 6 wherein said train of control cylinder means includes a final set cylinder means operable to cause said master cylinder means to stroke to its final setting from the same direction during both extension and retraction of said master cylinder means, said final set cylinder means being operable in response to bodily shifting movement of said pair of single-acting control cylinder means in one direction.

8. Apparatus according to claim 6 including a series of air control valves for controlling the supply of air under operating pressure to said control cylinder means, and air supply and exhaust manifold means leading to and from said air valves, said air valves being connected in parallel to an air supply and including a first pressure regulator means for controlling the operating air pressure to said double-acting control cylinder means and a second pressure regulator in series with said first pressure regulator for controlling the air pressure to said pair of single-acting cylinder means.

9. Apparatus according to claim 1 wherein said means for selectively extending and retracting includes a series of air control valves for controlling a supply of air under operating pressure to said control cylinder means, at least some of said air valves each including an air supply line leading to said valve and an air exhaust line leading from said valve, said air exhaust line including a variable flow control means for regulating the rate of flow of exhaust air from an associated said control cylinder means.

10. Apparatus according to claim 1 including high-speed valve means connected in parallel with said servo valve means for increasing the rate of flow of pressure fluid to and from said master cylinder means to increase the stroking speed thereof, said high-speed valve means normally being positioned to block fluid flow therethrough to and from said master cylinder means but being movable to an operating position upon a predetermined shifting movement of a portion of said cylinder train in either direction to direct flow therethrough during and in the same directional mode as the flow through said servo valve means to and from said set cylinder means.

11. Apparatus according to claim 10 wherein said cylinder train is operable upon a first predetermined movement in either direction to shift said servo valve means to an operating position to stroke said master cylinder means at a low speed and is operable upon a second predetermined movement greater than said first movement in the same said direction to shift said high-speed valve means to an operating position corresponding to said operating position of said servo valve means to stroke said master cylinder means at a high speed.

12. Apparatus according to claim 10 wherein said high-speed valve means is normally biased to a neutral flow-blocking position and is electrically operated for movement to either one of two positions for directing flow to the opposite sides of said master cylinder means, a pair of electrical limit switch means for operating said high-speed valve means, and switch-actuating means carried by said cylinder train for operating one of said pair of limit switch means upon said predetermined movement of said train in one direction and for operating the other of said pair of limit switch means upon said predetermined movement in the opposite direction.

13. Apparatus according to claim 10 connecting rod means interconnecting said other end of said cylinder train and said servo valve means, stop means limiting travel of said connecting rod means in opposite directions through a limited distance sufficient only to move said servo valve means from its neutral position to an operating position, said cylinder train including lost motion means enabling movement of said train in opposite directions through a distance greater than said limited distance, and valve-operating means associated with said cylinder train and operable upon predetermined movement of said train in opposite directions through a distance greater than said limited distance to move said high-speed valve means to an operating position.

14. Apparatus according to claim 13 wherein said lost motion means includes a pair of single-acting cylinder means in said cylinder train, said pair of cylinder means being subjected to a continual fluid pressure substantially less than the fluid-operating pressure of the remainder of said control cylinder means in said train, one of said pair of cylinder means being normally maintained in an extended condition and the other of said cylinder means normally being maintained in a retracted condition by said continual pressure.

15. Apparatus according to claim 14 wherein said pair of single-acting cylinder means are positioned at said other end of said train.

16. Apparatus according to claim 14 wherein said cylinder means of said pair have equal strokes.

17. Apparatus according to claim 14 wherein said valve-operating means includes limit switch means in a fixed position adjacent said train and limit switch-actuating means carried by a portion of said train movable relative to said pair of single-acting cylinder means.

18. Apparatus according to claim 10 including final set means including one of said control cylinder means for controlling the operation of said master cylinder means such that both extension and retraction of said master cylinder means through a selected distance occurs with a final stroking of said master cylinder means from the same direction.

19. Apparatus according to claim 1 including lockout means operable independently of said servo valve means to prevent stroking of said master cylinder means in response to a predetermined condition of said controlled device.

20. Apparatus according to claim 19 wherein said lockout means comprises a lockout valve means in a fluid passage means between said source of pressure fluid and said master cylinder means, said lockout valve means being normally positioned to permit fluid flow between said source and said master cylinder means but being movable to a position to block said flow in response to said predetermined condition.

21. Apparatus according to claim 20 wherein said lockout valve means is electrically operated and is in a fluid passage means between said servo valve means and said master cylinder means.

22. Apparatus according to claim 10 including lockout valve means positioned for blocking fluid flow between said master cylinder means and said servo and high-speed valve means to prevent stroking of said master cylinder means in response to a predetermined condition of said controlled device.

23. Apparatus according to claim 1 including final set means for controlling the operation of said master cylinder means such that extension and retraction of said master cylinder means to a final setting always occurs with a final stroking of said master cylinder means from only one direction.

24. Apparatus according to claim 23 wherein said final set means includes a final set control cylinder means in said cylinder train, said final set control cylinder means being operable upon a stroking of said master cylinder means in a selected direction opposite the said one direction of final set to cause an initial overstroking of said master cylinder means in said selected direction followed by a final stroking of said set cylinder means in said one direction of final set.

25. Apparatus according to claim 24 including final set cylinder-operating means including final set air valve means normally positioned to maintain said final set cylinder means in one of its two fully stroked conditions, and valve-actuating means operable upon a shifting movement of said cylinder train in said direction of final set to reposition said final set valve to stroke said final set cylinder means to its other said fully stroked condition to cause said overstroking.

* * * * *

UNITED STATES PATENT AND TRADEMARK OFFICE

CERTIFICATE OF CORRECTION

PATENT NO. : 3,945,299

DATED : March 23, 1976

INVENTOR(S) : RENE E. FRITZ and TED C. FOSTER

It is certified that error appears in the above-identified patent and that said Letters Patent are hereby corrected as shown below:

Column 1, line 28, "effected" should be --affected--;
Column 1, line 52, before "master cylinder" delete --set--;
Column 1, line 64, after "provide" delete --a--;
Column 2, line 44, after "of" delete --a--;
Column 2, line 57, "intersected" should be --inserted--;
Column 3, line 18, after "pressure" (first occurrence) insert --when--;
Column 3, line 26, "os" should be --so--;
Column 3, line 44, after "servo" insert --valve--;
Column 5, line 11, after "example" insert --in--;
Column 6, line 21, "operation" should be --operating--;
Column 7, line 13, after "bank" insert --80--;
Column 7, line 35, "the" (first occurrence) should be --of--;
Column 7, line 35, "sam" should be --same--;
Column 7, line 58, after "master" insert --cylinder--;
Column 7, line 61, "is" should be --it--;
Column 8, line 41, "premits" should be --permits--;
Column 9, line 24, "expansion" should be --extension--;
Column 9, line 54, "or" should be --of--;
Column 9, line 65, "cylinders 130" should be --cylinder 130--;
Column 10, line 9, after "limit" insert --switch--;
Claim 13, column 12, line 61, after "10" insert --including--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*